US008955485B2

(12) United States Patent
Kulkarni

(10) Patent No.: US 8,955,485 B2
(45) Date of Patent: Feb. 17, 2015

(54) INTAKE MANIFOLD

(71) Applicant: Ford Global Technologies, LLC, Dearborn, MI (US)

(72) Inventor: Milind B. Kulkarni, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/762,123

(22) Filed: Feb. 7, 2013

(65) Prior Publication Data

US 2014/0216387 A1 Aug. 7, 2014

(51) Int. Cl.

| | |
|---|---|
| ***F02M 35/10*** | (2006.01) |
| ***F02M 35/104*** | (2006.01) |
| *F02M 35/112* | (2006.01) |
| *F02B 27/00* | (2006.01) |

(52) U.S. Cl.

CPC ..... *F02M 35/1045* (2013.01); *F02M 35/10039* (2013.01); *F02M 35/10321* (2013.01); *F02M 35/10354* (2013.01); *F02M 35/112* (2013.01); *F02B 27/00* (2013.01)

USPC ..... 123/184.47; 123/184.24; 123/184.27; 123/184.37; 123/184.42

(58) Field of Classification Search

CPC ..... F02M 35/112; F02M 35/10039; F02M 35/10321; F02M 35/10354; F02B 27/00

USPC ..... 123/184.47, 184.27, 184.24, 184.37, 123/184.42

See application file for complete search history.

(56) References Cited

U.S. PATENT DOCUMENTS

| | | | | |
|---|---|---|---|---|
| 6,401,679 | B1 * | 6/2002 | Self | 123/184.31 |
| 6,446,591 | B1 | 9/2002 | Chae et al. | |
| 8,191,525 | B2 | 6/2012 | Born et al. | |
| 2004/0194750 | A1 * | 10/2004 | Tanikawa et al. | 123/184.42 |
| 2005/0279310 | A1 * | 12/2005 | Kondo et al. | 123/184.21 |
| 2010/0116237 | A1 * | 5/2010 | Taira et al. | 123/184.21 |
| 2010/0326395 | A1 * | 12/2010 | Lohr | 123/198 E |
| 2011/0100315 | A1 | 5/2011 | Vichinsky | |

* cited by examiner

*Primary Examiner* — Lindsay Low
*Assistant Examiner* — Charles Brauch
(74) *Attorney, Agent, or Firm* — Greg Brown; Alleman Hall McCoy Russell & Tuttle LLP

(57) ABSTRACT

Various systems for reducing noise, vibration, and harshness in an intake manifold are provided. In one example, an intake manifold includes one or more runners, a plenum fluidically coupled to the one or more runners, an inlet having a wall thickness, and a first and a second indentation, where the first indentation protrudes radially inward at a first inflection point in a first direction, the second indentation protrudes radially inward at a second inflection point in a second direction substantially anti-parallel to the first direction, and the wall thickness is maintained at the first and second inflection points. In this way, noise, vibration, and harshness associated with the intake manifold and its inlet may be reduced without additional weight, cost, or complexity.

20 Claims, 7 Drawing Sheets

INTAKE MANIFOLD

FIELD

The disclosure relates generally to intake manifolds, and systems for intake manifolds.

BACKGROUND AND SUMMARY

In combustion engines, intake manifolds provide air or air/fuel mixtures to cylinders. A throttle body coupled to an intake manifold at a first end may control the manifold pressure and flow delivered to the cylinders. The flow from the throttle body enters a plenum, which in turn directs the flow to a plurality of runners in fluidic communication with intake ports of the cylinders. In addition, intake manifolds are designed to reduce noise, vibration, and harshness (NVH) generated by the flow.

U.S. Pat. App. No. 2010/0326395 describes an intake manifold cover with braces integral to its exterior, provided to enhance the structure of the cover and reduce NVH. The braces extend upwardly and outwardly from brace flange portions which themselves extend outwardly from the intake manifold and are disposed between adjacent intake runner ports. The braces are integrally formed with the cover.

Although the above described braces are integrally formed with the intake manifold, their inclusion may increase the weight, cost, and complexity in forming the intake manifold beyond acceptable targets. Further, the inventors herein have recognized an interdependency between the noise/vibration generated by the manifold, and noise/vibration generated by flow passing by the throttle and entering the manifold. For example, certain actions taken to increase stiffness may exacerbate noise generated by flow past the throttle.

Systems for reducing NVH associated with an inlet in an intake manifold while reducing added weight, cost, and complexity are provided.

In one example, an intake manifold may include one or more runners and a plenum fluidically coupled to the one or more runners. The intake manifold may include an inlet having a wall thickness, a first indentation protruding radially inward at a first inflection point in a first direction, and a second indentation protruding radially inward at a second inflection point in a second direction substantially anti-parallel to the first direction. The wall thickness may be maintained at the first and second inflection points.

In this way, by including indentations in an intake manifold inlet flow passage, NVH associated with the intake manifold and its inlet may be reduced. Further, the intake manifold may provide and withstand sufficient pressures while minimizing resistance at its inlet, and maintain a sufficient seal with the throttle body and other components, without increasing wall thickness, weight, cost, or complexity. Further still, such an approach can work synergistically with approaches that reduce throttle flow noise, such as vanes positioned at the throttle inlet, while still maintaining weight, wall thickness, and other requirements.

In another example, a system is provided comprising a throttle body and an intake manifold coupled to the throttle body. The intake manifold may have one or more runners fluidically coupled to a plenum, a plurality of ribs extending along an exterior surface, and a top shell and a bottom shell oppositely joined together to thereby form the intake manifold. The inlet may have a double-humped cross-section with a first indentation and a second indentation, the first and second indentations extending radially inward at a first inflection point and a second inflection point, respectively. Ribs of the plurality of ribs may have a greater length at the first and second inflection points. The one or more runners may not have the double-humped cross-section.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-7 are drawn approximately to scale, although other relative dimensions may be used, if desired.

DETAILED DESCRIPTION

The following description relates to an intake manifold having a first and a second non-linear indentation oppositely positioned from one another aligned along a central length of a non-linear manifold inlet passage and configured to reduce noise, vibration, and harshness (NVH) associated with the manifold and its inlet. The manifold may be an intake manifold or other type of manifold. The first indentation may protrude radially inward at a first inflection point in a first direction, while the second indentation may protrude radially inward at a second inflection point in a second direction substantially anti-parallel to the first direction. The wall thickness of the manifold may be maintained at the first and second inflection points. In this way, NVH associated with the manifold and its inlet may be reduced while sufficient pressure and sealing are attained without adding weight, cost, or complexity to the manifold.

The present disclosure may use perspective-based descriptions such as up/down, back/front, and top/bottom, and/or orientation-based descriptions such as height, width, length and thickness. Such descriptions may be used to describe presently disclosed embodiments, and/or may be used in the description of other disclosures in a comparative way, and may merely be used to facilitate the discussion and are not intended to restrict the application of embodiments disclosed herein.

Figure 1:
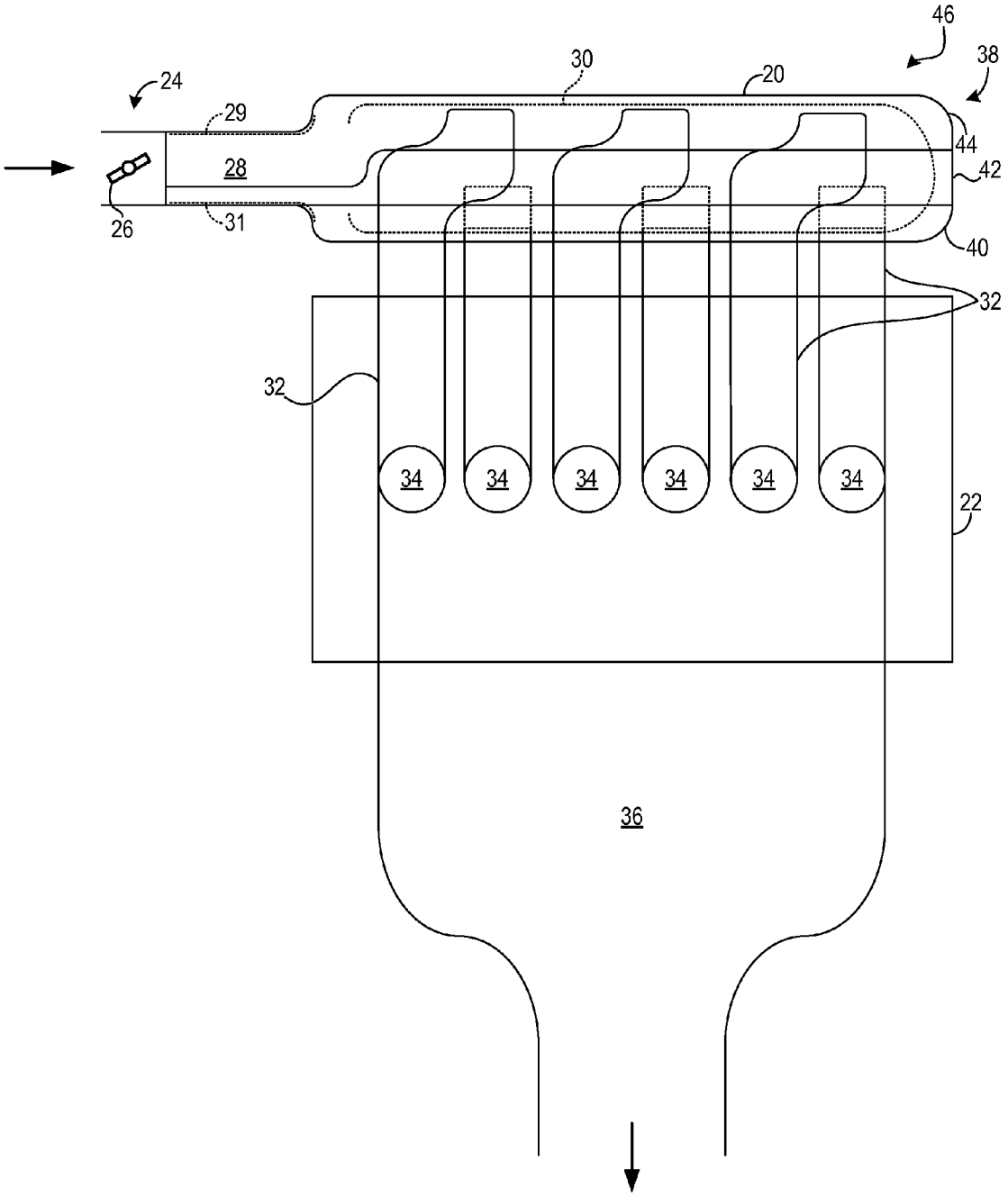
FIG. 1 is a system view of an intake manifold in accordance with the present disclosure.

FIG. 1 is a schematic diagram illustrating example elements of an internal combustion engine in accordance with the present disclosure. The elements may include an intake manifold 20 and an engine block 22. Intake manifold 20 is shown communicating with a throttle body 24 via a throttle plate 26 through an inlet 28, where a face of intake manifold 20 may be sealingly coupled to throttle body 24. In this particular example, throttle plate 26 may be coupled to an actuator such as an electric motor (not shown) so that the position of throttle plate 26 may be controlled by a controller. This configuration is commonly referred to as electronic throttle control (ETC) which may also be utilized during idle speed control.

Inlet 28 may be configured to pass intake air to intake manifold 20, and may include one or more indentations configured to reduce NVH, described in further detail below with reference to an example embodiment shown in FIGS. 2-7. Intake manifold 20 may receive air from a charge air cooler (not shown), which may decrease the temperature of intake gases. In some embodiments, the charge air cooler may be an air to air heat exchanger. In other embodiments, charge air cooler may be an air to liquid heat exchanger.

Intake manifold 20 may include a plenum 30. Plenum 30 may be an elongate hollow chamber open at an inlet end and configured to receive the intake air, for example from inlet 28. Intake manifold 20 may also be configured to divide the intake air into a number of individual air flows via a corresponding number of runners 32. Runners 32 may be collectively coupled at a first end to plenum 30 and each at a second end respectively coupled to a corresponding number of combustion chambers 34, illustrated here schematically with circles. Combustion chambers 34 may be coupled to a cylinder head. Each combustion chamber 34 may also receive fuel for combustion via, for example, a corresponding number of fuel injectors. The fuel injectors may, for example, inject fuel in proportion to the pulse width of a signal received from an engine controller. The combusted air fuel mixture may be expelled via an exhaust manifold 36. Thus, intake manifold 20 and exhaust manifold 36 may selectively communicate with combustion chambers 34 via respective intake valves and exhaust valves (not shown). In some embodiments, combustion chambers 34 may include two or more intake valves and/or two or more exhaust valves. Six runners 32 and six combustion chambers 34 are illustrated in this example. In other examples, other numbers of runners may be used, and/or other numbers of combustion chambers. As seen partially in FIG. 5, runners 32 may have substantially rectangular cross-sections (e.g., having two parallel sides and two slanted sides such that runners have varying cross-sections), though such geometry may be varied without departing from the scope of this disclosure. For example, runners 32 may instead have circular or substantially cylindrical cross-sections (e.g., elliptical). Further, two or more runners 32 may be substantially aligned vertically (e.g., within 10 degrees) with each other near inlet 28 and extend in nonparallel directions to become misaligned at an outlet end. Such an arrangement may conserve space and enhance the structural integrity of the runners.

The intake manifold 20 may include a number of formed pieces 38 which may be assembled together in three layers to form the assembled manifold 20. For example, three formed pieces, e.g., a first formed piece 40, a second formed piece 42, and a third formed piece 44 may be stacked and/or otherwise joined to form an assembly 46. In this way, individual components (e.g., inlet 28, runners 32) of intake manifold 20 may be formed by assembling together two or more formed pieces. For example, second formed piece 42 may form a bottom portion of one or more runners 32 and a top portion of other of runners 32. First formed piece 40 and/or third formed piece 44 may form exterior walls of runners 32, which may correspond to an exterior surface of intake manifold 20. The assembly of the formed pieces may be carried out with various suitable methods, for example welding. Although exactly three formed pieces are shown in the illustrated example, other embodiments are possible in which the intake manifold 20 is formed by oppositely joining together two formed pieces—a top and a bottom shell. For the sake of illustration, the top shell may correspond to third formed piece 44 and the upper half of second formed piece 42, while the bottom shell may correspond to first formed piece 40 and the bottom half of second formed piece 42.

Each of the formed pieces 38 may be formed separately and/or individually for example, via molding, and/or stamping, and the like. For example, the formed pieces 38 may be made from injection molded plastic. Each formed piece 38 may have a first side and a second side exposed during the formation process thereof. In this way a substantially high level of detail and number of surface features may be included on multiple surfaces in the assembly. Three formed pieces 40, as illustrated in the example shown, may therefore provide six possible sides wherein multiple features may be selectively and readily included inside the assembled manifold. In this way, an overall improved manifold may be achieved.

The intake manifold 20 may include a first indentation 29 and a second indentation 31, each at least partially spanning the length of inlet 28 and protruding radially inward toward a center of intake manifold 20. First indentation 29 is included at a top portion of intake manifold 20, while second indentation 31 is included at a bottom portion of intake manifold, where both indentations may follow a common, curved oath along a central axis of inlet 28. Intake manifold 20 thus includes two oppositely oriented indentations. The indentations are configured to reduce NVH associated with the intake manifold and inlet 28, and may be disposed in the one or more formed pieces. For example, first indentation 29 may be formed third formed piece 44 and second indentation 31 may be formed in first formed piece 40. In an alternative embodiment in which intake manifold 20 is formed by joining a top and bottom shell, first indentation 29 may be disposed in the top shell and the second indentation 31 disposed in the bottom shell.

Figure 2:
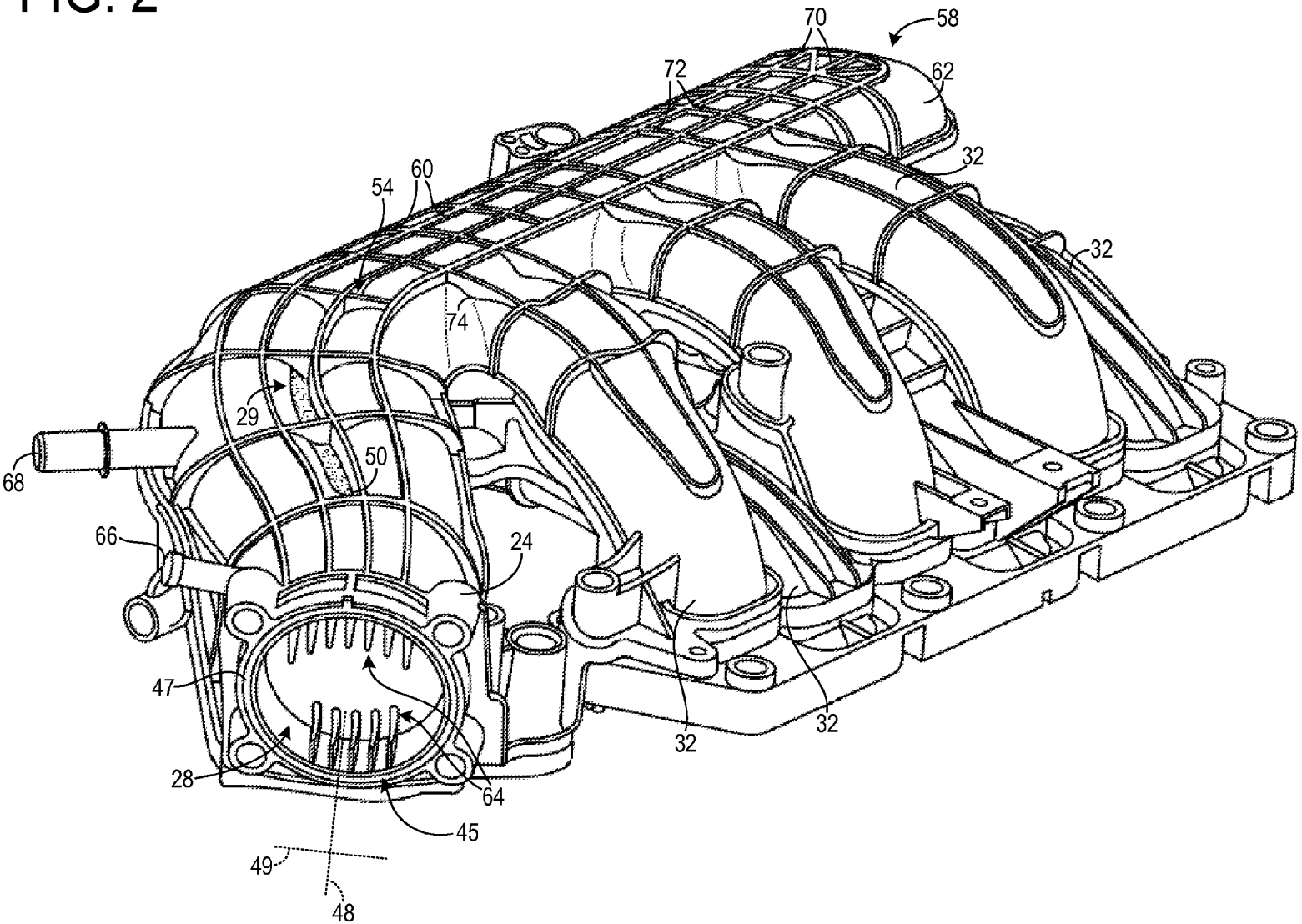
FIG. 2 is an assembled view of an intake manifold in accordance with the present disclosure.
Figure 3:
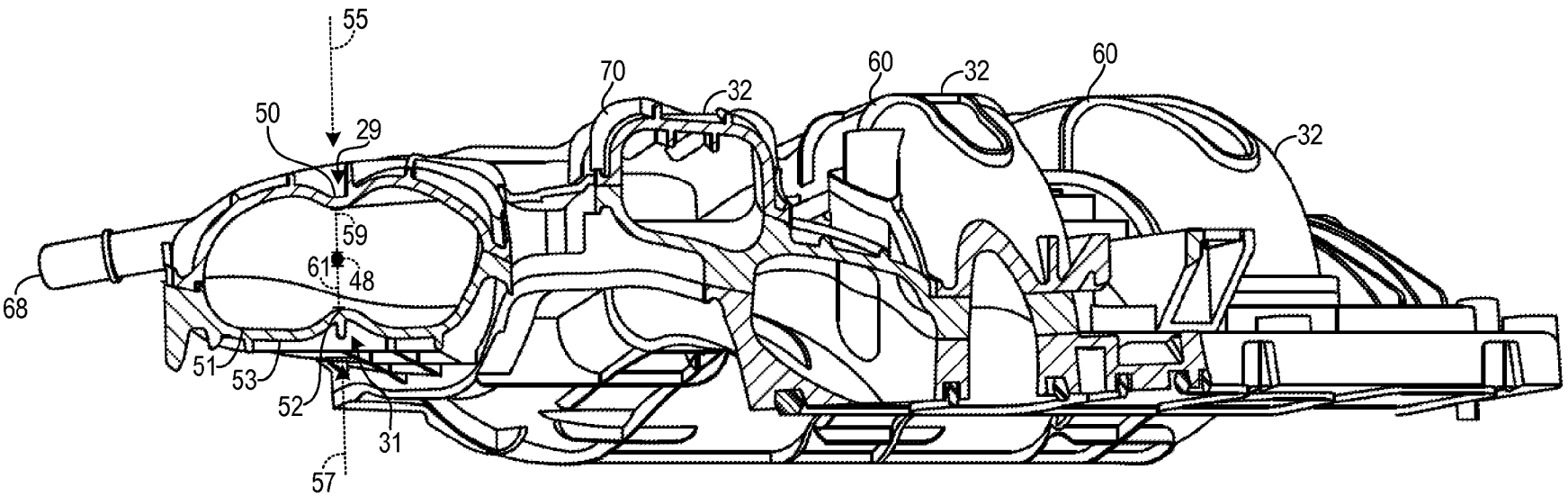
FIG. 3 is a sectional view of the intake manifold shown in FIG. 2.
Figure 4:
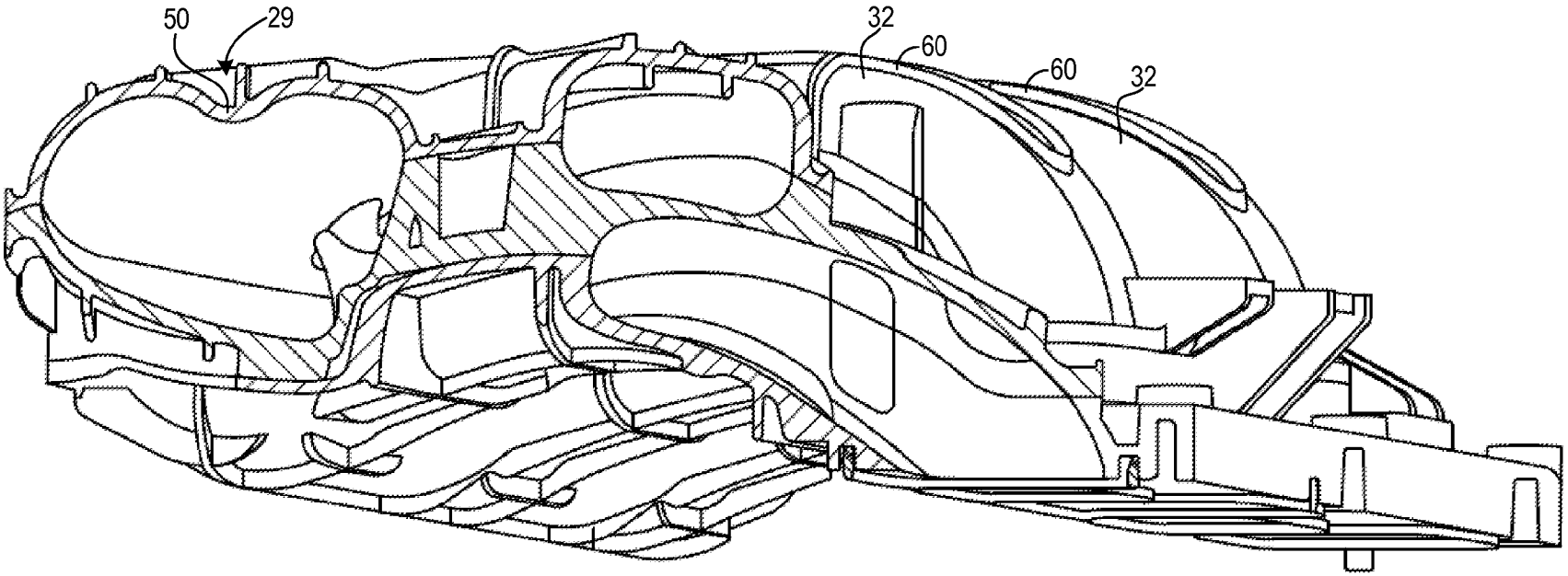
FIG. 4 is another sectional view of the intake manifold shown in FIG. 2.
Figure 5:
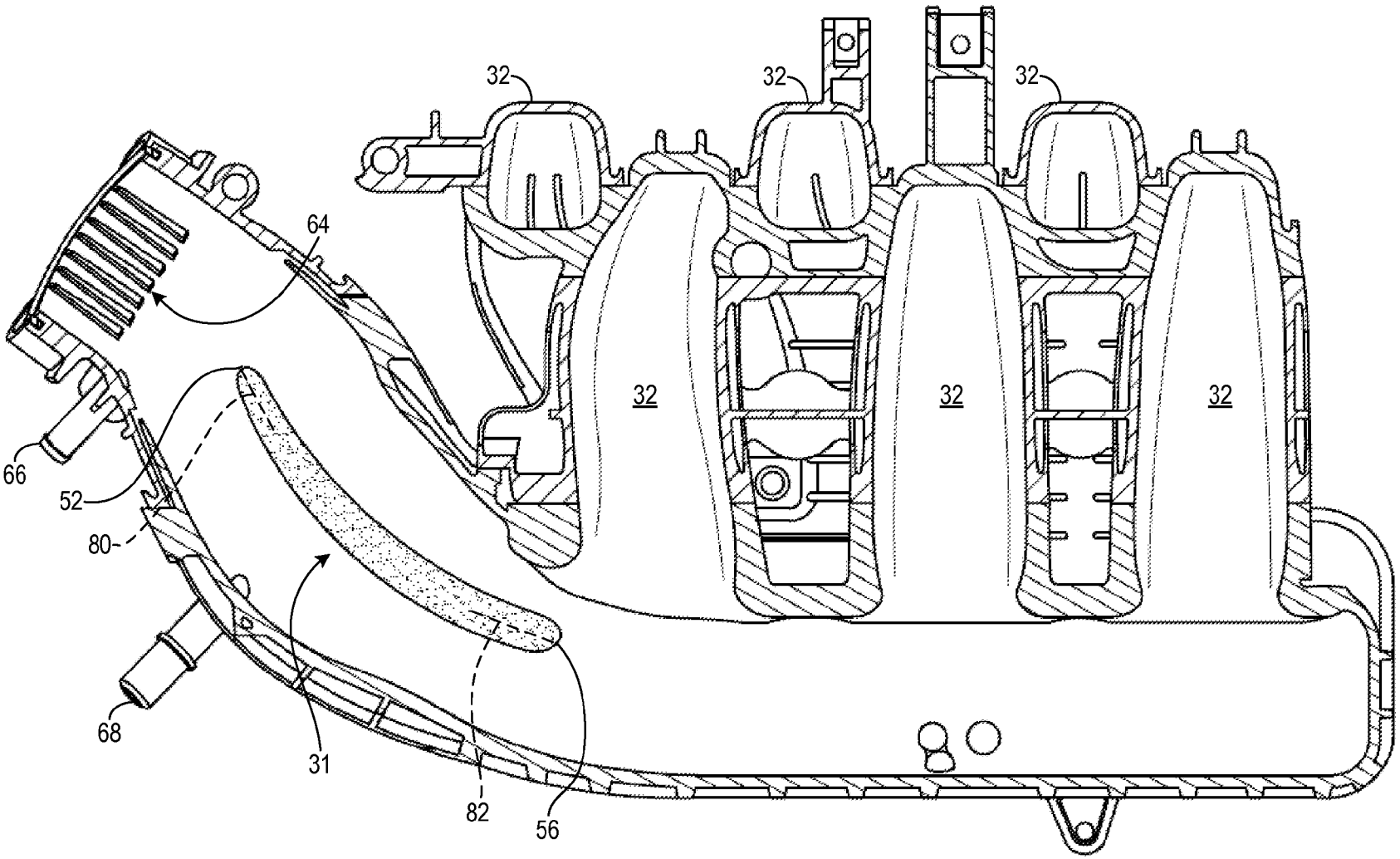
FIG. 5 is a bottom sectional view of the intake manifold shown in FIG. 2.
Figure 6:
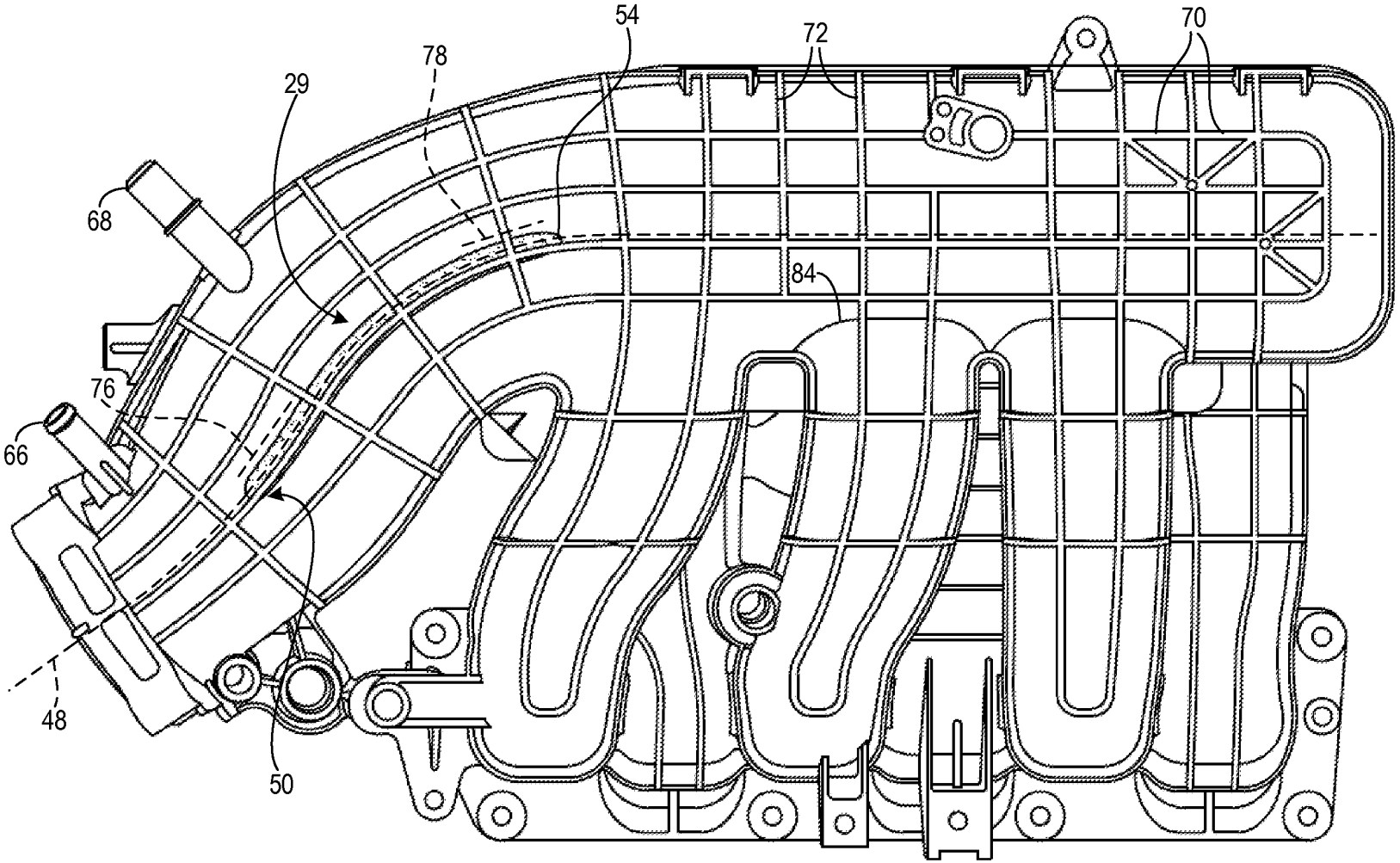
FIG. 6 is a top view of the intake manifold shown in FIG. 2.
Figure 7:
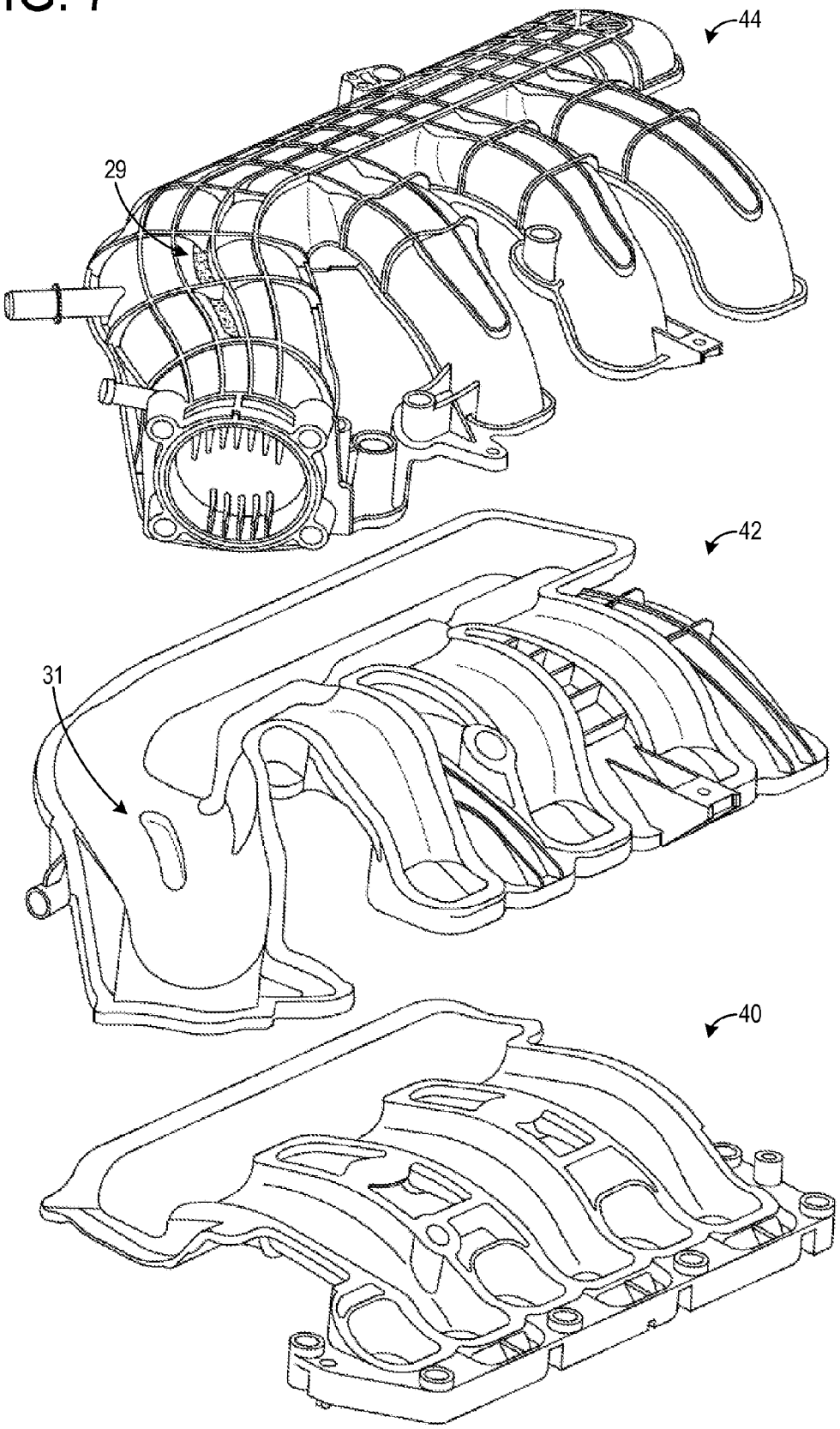
FIG. 7 is an exploded view of the intake manifold shown in FIG. 2.

FIG. 2 is an assembled view of an example intake manifold 20 in accordance with the present disclosure; FIG. 3 is a sectional view of intake manifold 20; FIG. 4 is a another sectional view of intake manifold 20; FIG. 5 is a bottom sectional view of intake manifold 20; FIG. 6 is a top view of intake manifold 20; and FIG. 7 is an exploded view of intake manifold 20.

As shown in FIGS. 2-7, intake manifold 20 includes first indentation 29 and second indentation 31 which each protrude radially inward toward a central axis 48 of the intake manifold and are configured to reduce NVH associated with the intake manifold and its inlet 28. Central axis 48 is provided for illustrative purposes, and in this example has a sinuous path extending from a curved region corresponding to inlet 28 to a substantially straight region corresponding to plenum 30, giving central axis 48 a curved, s-like shape. At inlet 28, central axis 48 substantially corresponds to the center of inlet 28, while at plenum 30 central axis 48 substantially corresponds to the center of plenum 30. Such correspondence may be, for example, on the order of 10 millimeters. Central axis 48 thus substantially corresponds to the center of intake manifold 20, which has a complex geometry. A front face 45 of the inlet 28 may include a seal 47 circumferentially around the inlet 28 so that a throttle body may mate contiguously with front face 45. The throttle body may include a throttle, as noted above, that pivots about a rotational axis 49 to thereby control flow induction.

First and second indentations 29 and 31 may also be referred to as waves or humps, with the two in combination referred to as a double hump structure having a double-humped cross-section particularly illustrated in FIGS. 3 and 4. Further, first and second indentations 29 and 31 may have what is referred to as a centrally-tapered cross section formed by a tapered region characterized by inflection points.

A first inflection point 50 and a second inflection point 52 identify the starting points and establish the protrusion direction of first and second indentations 29 and 31, respectively, whose beginnings are disposed a selected distance downstream of throttle body 24 and inlet 28 along central axis 48. As best seen in the sectional view illustrated in FIG. 3, first and second inflection points 50 and 52 correspond to a concave curvature of intake manifold 20 with respect to central axis 48 and separate such concave curvature from the surrounding convex curvature with respect to central axis 48 which imparts an elliptical geometry to the interior of intake manifold 20. First and second inflection points 50 and 52 also are positioned in regions where the radius of intake manifold 20, measured by a line extending from central axis 48 to an inner wall 51 of the intake manifold, decreases. The degree to which first and second inflection points 50 and 52 protrude radially inward toward central axis 48 may be selectively adjusted and tuned to desired parameters including engine output. Such protrusion may be, for example, 20 mm, compared to an intake manifold lacking indentations. As another example, the protrusion may be on the order of the wall thickness of intake manifold 20, where, in one example, the wall thickness is defined as the distance between inner wall 51 and an outer wall 53 of intake manifold 20. Further, as the protrusion degree of first and second inflection points 50 and 52 at least partially controls the protrusion degrees of first and second indentations 29 and 31, so too can the degree of indentation protrusion be controlled by selectively adjusting the protrusion degrees of first and second inflection points 50 and 52.

First and second inflection points 50 and 52 also characterize the direction in which the indentations protrude. In the illustrated examples, first indentation 29 protrudes radially inward in a first direction 55 while second indentation 31 protrudes radially inward in a second direction 57, where the first and second directions 55 and 57 are substantially anti-parallel to each other (e.g., extending along the same axis but in opposite directions). Further, indentations 29 and 31 are substantially vertically aligned with central axis 48 (e.g., aligned within 5% or less), roughly dividing intake manifold 20 into two substantially equal tube-like halves in an open flow area of inlet 28 (e.g., surface areas within 20% of each other). First and second inflection points 50 and 52 are conversely substantially perpendicular (e.g., within 10 degrees) to central axis 48. Other embodiments are possible, however, including those in which indentations 29 and 31, and inflection points 50 and 52, may instead be misaligned with central axis 48 or each other, and may divide intake manifold 20 into unequal halves and/or more than two portions.

The wall thickness of intake manifold 20 may be maintained throughout regions in which indentations are disposed. FIG. 3 particularly illustrates how the wall thickness is maintained at cross-sections intersecting inflection points 50 and 52. In other words, double humps are provided by contouring the shape of intake manifold 20, and its formed pieces if applicable, rather than by adding material and increasing the wall thickness. First and second inflection points 50 and 52, and first and second indentations 29 and 31, are features of inner wall 51 and outer wall 53. In this way, indentations may be provided to reduce NVH associated with intake manifold 20 and inlet 28 without introducing additional weight, cost, or complexity. In other embodiments, however, indentations may be provided by adding material and increasing wall thickness. In this example, indentations may be provided during the formation of formed pieces 40, 42, and 44 when their interior surfaces are exposed.

A first termination point 54 and a second termination point 56 conversely mark the end points of the first and second indentations 29 and 31, respectively, and further establish the path the indentations traverse. In this example, first and second termination points 54 and 56 are disposed upstream of plenum 30 and runners 32, causing first and second indentations 29 and 31 to extend along central axis 48 along a direction substantially corresponding (e.g., parallel) to a flow direction of the air/fuel mixture flowing through intake manifold 20. As shown, first and second indentations 29 and 31 extend throughout a curved region of intake manifold 20 but truncate before reaching a substantially straight (e.g., linear) region, which may correspond to plenum 30. First and second indentations 29 and 31 may, for example, end at a most upstream runner junction 84, the junction marking a joining point between a runner and the plenum. The placement of termination points 54 and 56 may be selectively adjusted and tuned to various desired parameters without departing from the scope of this disclosure. For example, first and second termination points 54 and 56 may instead be disposed in proximity to a right end 58 of intake manifold 20, causing first and second indentations 29 and 31 to substantially traverse the full length of central axis 48. Further, in other embodiments, additional inflection and termination points may be provided such that two or more indentations are included for a given region of intake manifold 20 (e.g., the top portion corresponding to first indentation 29). In this example, a plurality of indentations is provided which may be separated by portions of non-indented material. Such a configuration may be utilized, for example, for scenarios in which the formation of a contiguous indentation in a given manifold region is impractical, costly, and/or unnecessary.

In the illustrated examples, first inflection point 50 and its corresponding first termination point 54, along with second inflection point 52 and second termination point 56, protrude radially inward toward central axis 48 in equal amounts. For example, their depths as measured by lines (e.g., a first line 59 measuring the depths of first inflection point 50 and first termination point 54, and a second line 61 measure the depths of second inflection point 52 and second termination point 56) extending from central axis 48 are equivalent. Thus, first and second indentations 29 and 31 have equal depths and each maintain a consistent depth throughout their lengths as they are traversed along central axis 48. It will be understood, however, that an inflection point and its corresponding termination point may have unequal depths, first and second indentations 29 and 31 may have unequal depths, and first and/or second indentations 29 and 31 may each have depths which change as they are traversed along central axis 48 without departing from the scope of this disclosure.

The shapes with which first and second indentations 29 and 31, and first and second inflection points 50 and 52, protrude inward may also be varied. As shown in the illustrated examples, first and second inflection points 50 and 52 protrude radially inward with a smooth, curved geometry that is at least partially complementary to its surrounding convex geometry. Such geometry may be varied without departing from the scope of this disclosure. For example, inflection points may be provided which protrude radially inward with a square-like or rectangular geometry. Sharp inflection points which are substantially triangular may also be provided. Further, the width of inflection points may be selectively adjusted based on desired parameters. In the illustrated examples, the widths of first and second inflection points 50 and 52 are equal and on the order of the wall thickness of intake manifold 20. In other examples, such widths may be unequal and/or substantially smaller or larger (e.g., twice as large) than the wall thickness.

Intake manifold 20 also includes a plurality of ribs 60 disposed across an exterior surface 62 which act to further reduce NVH associated with the manifold and strengthen and stiffen the manifold. The plurality of ribs 60 is arranged in a substantially cross-hatched manner (e.g., perpendicular pairs of ribs bounding rectangular regions) and protrudes radially outward with smooth, ridge-like geometry. The plurality of ribs 60 includes a plurality of axial ribs 70 extending along central axis 48 from throttle body 48 toward right end 58 along a top region of intake manifold 20. The plurality of ribs 60 further includes a plurality of lateral ribs 72 extending circumferentially in a direction substantially perpendicular (e.g., within 10 degrees) to central axis 48, wherein individual lateral ribs have unequal starting and ending points; lateral ribs corresponding to inlet 28, for example, span the top half of intake manifold 20 in that region, while other lateral ribs span a smaller width, for example at the region corresponding to plenum 30 in between runners 32. Thus, in this example, axial ribs 70 and lateral ribs 72 intersect one another to thereby form the cross-hatched geometry shown. Other geometries may be used, however, such as concentric, circular geometry.

As shown, two lateral ribs 72 intersect first indentation 29 and a third lateral rib 72 is disposed between throttle body 24 and first inflection point 50. An axial rib 70, substantially spanning the length of intake manifold 20 as measured along central axis 48, intersects and corresponds to the path of first indentation 29. Such axial and lateral ribs may cooperate with indentation 29 to maximize reduction of NVH.

In the illustrated examples, some ribs in the plurality of ribs 60 have equal lengths, as measured by their extension radially outward from exterior surface 62. Other ribs, such as those disposed along indentations 29 and 31 and those spanning joint regions between plenum 30 and runners 32 (e.g., joint 84) have greater lengths than those disposed elsewhere. Such ribs extend radially outward from exterior surface 62 to a greater degree, matching the lengths of other ribs not disposed along the indentations or joint regions. Such an arrangement allows the plurality of ribs 60 to form a substantially continuous surface; in other words, a flexible material disposed on and supported by the plurality of ribs 60 would be continuous and substantially smooth without sharp peaks or valleys.

As shown, the plurality of ribs 60 partially extends along portions of exterior surface 62 which correspond to runners 32. In this way, NVH associated with runners 32 may be minimized. More particularly, a top set of three runners 32 include ribs 60 which extend along their exterior surfaces. Ribs 60 disposed along these runners truncate toward a lateral side of intake manifold 20 in a curved manner such that two adjacent lateral ribs 72 become joined together at the lateral side. FIG. 2 particularly illustrated how, due to the complex geometry of intake manifold 20, the areas bounded by a given pair of lateral ribs and an adjacent pair of axial ribs are unequal and may vary with region; areas bounded by axial and lateral ribs corresponding to inlet 28 are substantially rectangular and expand as intake manifold 20 is traversed along central axis 48. Areas bounded by axial and lateral ribs corresponding to plenum 30 are rectangular and substantially uniform. Still further, areas bounded by axial and lateral ribs corresponding to the top three runners 32 vary between rectangular and curved and vary among individual runners. It will be appreciated that other geometric arrangements, sizes, orientations, etc. are possible without departing from the scope of this disclosure.

In the illustrated examples, runners 32 lack indentations similar to indentations 29 and 31, and instead rely on exterior ribs 60 to reduce NVH. Consequently, runner cross-sections are substantially rectangular. It will be appreciated, however, that additional indentations specific to runners 32 may be provided. For example, each runner may include two, oppositely oriented indentations protruding radially inward and extending along central axes of the runners. The runner indentations may be aligned with central axes disposed centrally to each runner 32. The runner indentations may have lengths spanning at least portions of the runners and may be disposed closer to plenum 30 or oppositely to the open ends through which fluid is supplied. One or more axial and/or lateral ribs may further intersect such runner indentations and may thus cooperate with runner indentations to reduce NVH.

Indentations 29 and 31, and the plurality of ribs 60, may cooperate to reduce NVH associated with intake manifold 20 and inlet 28. As seen in the illustrated examples, indentation 29 is aligned with ribs 60 disposed immediately thereabove. Such alignment may reduce NVH compared to a manifold in which indentations and ribs are misaligned, and may further allow an indentation to cancel out NVH produced by adjacent ribs and vice versa. Additional components may advantageously utilize alignment. For example, intake manifold 20 includes a plurality of vanes 64 proximate inlet 28 and throttle body 24 and which are disposed upstream of first and second indentations 29 and 31. Vanes 64 may further reduce NVH associated with intake manifold 20 and inlet 28, and may have a longitudinal axis which is aligned with central axis 48 and an air/fuel flow path flowing from the manifold to runners 32. Vanes 64 may further be substantially perpendicular (e.g., within 10 degrees) to rotational axis 49 and have a longitudinal axis (e.g., central axis 48) which is unaligned with several longitudinal axes: a starting longitudinal axis 76 corresponding to a starting region of first indentation 29, an ending longitudinal axis 78 corresponding to an ending region of first indentation 29, a starting longitudinal axis 80 corresponding to a starting region of second indentation 31, and an ending longitudinal axis 82 corresponding to an ending region of second indentation 31. Such alignment may allow for the reduction of NVH while minimizing resistance to the air/fuel flow path at inlet 28. Vanes 64 are further tapered; their widths increase as they are traversed along central axis 48 with a taper angle which may be adjusted. Vanes 64 have lengths along central axis 48 which substantially span the entire length along central axis 48 of throttle body 24, though such lengths may be selectively altered. As best seen in FIG. 2, the plurality of vanes 64 includes a bottom set of five vanes and an upper set of seven vanes. A larger number of upper vanes may be included according to the flow characteristics of intake manifold 20, for example.

In this way, a plurality of components of intake manifold 20 may cooperate to synergistically reduce NVH beyond what may be possible with individual components alone. For example, vanes 64 may have lengths and tapered widths adapted to reduce NVH associated with throttle body 24. First and second indentations 29 and 31 may then reduce NVH not affected by vanes 64 and NVH associated specifically with inlet 28 downstream of vanes 64. First and second indentations 29 and 31 may have various characteristics (e.g., length, curvature, depth, etc.) adapted to NVH downstream throttle body 24 and upstream of plenum 30. Further, ribs 60 may reduce NVH not addressed by the vanes or indentations and NVH associated with other components and/or regions. Thus, a plurality of components in intake manifold 20 may work cooperatively to enhance NVH reduction associated with intake manifold 20 and inlet 28.

It will be appreciated, however, that the alignment, width, height, and tapering shown in the figures are provided for the purpose of illustration and that these parameters may be varied, for example according to flow characteristics of air/fuel flowing through intake manifold 20.

Intake manifold 20 also includes a first tube 66 and a second tube 68, which may be configured to perform a variety of functions including introducing and/or expelling flow, removing condensate, controlling PCV, etc. In this embodiment, first tube 66 is fluidically coupled to intake manifold 20 and disposed upstream of indentations 29 and 31. Second tube 68 is also fluidically coupled to intake manifold 20 but disposed downstream of first tube 66 and in a region corresponding to indentations 29 and 31. Such placement may allow NVH produced by tubes 66 and 68 to be cancelled by indentations 29 and 31.

In this way, an intake manifold may be provided including one or more runners, a plenum fluidically coupled to the one or more runners, an inlet having a wall thickness, a first and second indentation each protruding radially inward in anti-parallel directions from first and second inflection points, respectively. NVH associated with the intake manifold and its inlet may be reduced without increasing the wall thickness at the inflection points. Thus, NVH may be reduced without increasing the weight, cost, and complexity associated with the intake manifold.

It will be appreciated that aspects of the intake manifold may be varied without departing from the present disclosure. For example, the number, disposition, path, and depth of indentations may be varied, as well as the number, disposition, and depth of inflection points. The geometric arrangement, density, height of ribs may be further varied as well as the disposition and geometry of the vanes and tubes. Still further, the runners, inlet, plenum and other components may be comprised of composite materials including one or more of plastics, resins, and polymers, though other materials may be used.

It will be also appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An intake manifold, comprising:

a plenum fluidically coupled to one or more runners;

an inlet positioned upstream the plenum and including a first indentation protruding radially inward in a first direction and a second indentation protruding radially inward in a second direction substantially anti-parallel to the first direction, the inlet having a cross-section of two conjoined circular pipes that join at the first indentation and the second indentation; and wherein an inlet wall thickness is maintained at the first and second indentations.

2. The intake manifold of claim 1, wherein beginnings of the first and second indentations are disposed a selected distance downstream of a front face of the inlet and upstream of the plenum and where the first and second indentations extend longitudinally to ends of the first and second indentations, the ends of the first and second indentations being a greater length from an inlet seal than an intersection of a wall of a runner leading to a cylinder from the plenum and a wall of the inlet, the runner leading to the cylinder from the plenum a closest runner leading to a cylinder from the plenum.

3. The intake manifold of claim 1, wherein the first and second indentations extend axially along the intake manifold in a curved region, where the first indentation protrudes radially inward at a first inflection point, and where the second indentation protrudes radially inward at a second inflection point.

4. The intake manifold of claim 1, wherein the inlet has a double-humped cross-section formed by the first and second indentations, and where the first and second indentations extend in a longitudinal direction of the inlet a distance greater than a diameter of a tube positioned along a wall of the inlet.

5. The intake manifold of claim 1, further comprising a plurality of vanes protruding from a manifold wall inward at the inlet into the intake manifold.

6. The intake manifold of claim 1, wherein the one or more runners, inlet, and plenum comprise three shells mating with one another, and where longitudinal sides of the first and second indentations are parallel with a direction of air flow into the intake manifold.

7. The intake manifold of claim 6, further comprising a plurality of vanes protruding from a manifold wall inward at the inlet into the intake manifold, and wherein a longitudinal axis of the vanes is unaligned with a starting and ending longitudinal axis of the indentations.

8. The intake manifold of claim 1, further comprising a plurality of ribs disposed across an exterior surface of the intake manifold.

9. The intake manifold of claim 8, wherein ribs in the plurality of ribs are arranged in a substantially cross-hatched manner and extend at least partially along exterior surfaces of the one or more runners.

10. The intake manifold of claim 3, wherein the first and second inflection points separate a concave region with respect to a central axis from a surrounding convex region with respect to the central axis.

11. A system, comprising:

a throttle body; and an intake manifold having an inlet runner located upstream a plenum and coupled adjacent to the throttle body, the inlet runner having walls with first and second indentations, the first and second indentations ending at locations farther from an inlet seal than an intersection of a runner leading to a cylinder from the plenum and a wall of the inlet runner, the runner leading to the cylinder from the plenum a closest runner to the inlet seal.

12. The system of claim 11, wherein the first and second indentations are disposed in a top shell and a bottom shell, respectively.

13. The system of claim 11, further comprising at least a top shell and a bottom shell oppositely positioned to form the intake manifold.

14. The system of claim 11, further comprising a plurality of runners coupled to a cylinder head.

15. The system of claim 11, wherein the intake manifold has a wall thickness which is maintained at the first and second indentations.

16. The system of claim 11, wherein a longitudinal section of the inlet runner includes a cross section flow area in a shape similar to an outer boundary of Arabic numeral eight.

17. The system of claim 11, wherein the first and second indentations follow a common, curved inlet path along a central axis of the inlet runner.

18. The system of claim 11, wherein the first and second indentations end at a most upstream runner junction to the plenum.

19. The system of claim 11, wherein ribs of a plurality of ribs have a greater length at the first and second indentations.

20. A system, comprising:

a throttle body; and an intake manifold having an inlet located upstream of a plenum and coupled to the throttle body, one or more runners fluidically coupled to the plenum, a plurality of ribs extending along an exterior surface of the inlet, and a top shell and a bottom shell oppositely joined together to thereby form the intake manifold, a first tube and a second tube each fluidically coupled to the intake manifold, the inlet having a centrally double tapered cross-section with a first indentation and a second indentation, each indentation extending radially inward opposite one another to reduce noise and vibration, the centrally double tapered cross-section viewed in a same plane as a cross-section of a central axis of the inlet, the first and second indentations extending longitudinally in a longitudinal direction of the inlet, the one or more runners not having a double-humped cross-section, and a plurality of vanes proximate the inlet and upstream of the centrally-tapered cross-section.

* * * * *